US011317656B2

(12) United States Patent
Craig

(10) Patent No.: US 11,317,656 B2
(45) **Date of Patent: *May 3, 2022**

(54) SOCK WITH ZONES OF VARYING LAYERS

(71) Applicant: NIKE, Inc., Beaverton, OR (US)

(72) Inventor: Kenneth T. Craig, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 112 days.

This patent is subject to a terminal disclaimer.

(21) Appl. No.: 16/812,007

(22) Filed: Mar. 6, 2020

(65) Prior Publication Data

US 2020/0205482 A1 Jul. 2, 2020

Related U.S. Application Data

(60) Continuation of application No. 15/178,867, filed on Jun. 10, 2016, now Pat. No. 10,624,395, which is a division of application No. 13/090,813, filed on Apr. 20, 2011, now Pat. No. 9,365,960.

(51) Int. Cl.
*A41B 11/00* (2006.01)
*D04B 1/26* (2006.01)

(52) U.S. Cl.
CPC ..... *A41B 11/005* (2013.01); *D04B 1/26* (2013.01); *D10B 2403/023* (2013.01)

(58) Field of Classification Search
CPC ..... A41B 11/005; A41B 11/003; D04B 1/26; D04B 2403/023; D10B 2501/021; A41D 11/01
See application file for complete search history.

(56) References Cited

U.S. PATENT DOCUMENTS

| | | | |
|---|---|---|---|
| 294,020 | A | 2/1884 | Eisendrath |
| 379,831 | A | 3/1888 | Sutro |
| 1,601,020 | A | 9/1926 | Holden et al. |
| 2,263,763 | A | 11/1941 | Edwards |
| 2,334,206 | A | 11/1943 | Herbert |
| 2,699,056 | A | 1/1955 | Margulies |
| 2,714,813 | A | 8/1955 | Roscoe |
| 2,720,097 | A | 10/1955 | De Mond |
| 3,259,915 | A | 7/1966 | Dison |

(Continued)

FOREIGN PATENT DOCUMENTS

| | | | |
|---|---|---|---|
| CN | 2742787 | Y | 11/2005 |
| CN | 201199927 | Y | 3/2009 |

(Continued)

OTHER PUBLICATIONS

Office Action received for European Patent Application No. 16192859.3, dated Jan. 26, 2021, 8 pages.

(Continued)

*Primary Examiner* — Alissa L Hoey
(74) *Attorney, Agent, or Firm* — Shook, Hardy & Bacon L.L.P.

(57) ABSTRACT

A sock with zones of varying numbers of layers is formed as a single tube on a circular knitting machine. At least one end of the tube is doubled back over a portion of the remainder of the tube to form a double layer first zone. The sock further includes a single layer zone adjacent to the double layer first zone, where no such folding occurs. Optionally, a second end of the tube may also be folded to create a third zone having two layers of material.

17 Claims, 13 Drawing Sheets

(56) References Cited

U.S. PATENT DOCUMENTS

| | | | | |
|---|---|---|---|---|
| 3,395,554 | A | 8/1968 | Wallner, Jr. | |
| 3,548,614 | A | 12/1970 | Boyer, Jr. et al. | |
| 3,685,320 | A | 8/1972 | Gorini | |
| 3,721,111 | A | 3/1973 | Billi | |
| 3,796,067 | A | 3/1974 | East | |
| 3,841,113 | A | 10/1974 | Lucke et al. | |
| 3,905,212 | A | 9/1975 | Bounous et al. | |
| 4,008,350 | A * | 2/1977 | Crawford | A41B 11/00 521/54 |
| 4,028,910 | A | 6/1977 | Wignail et al. | |
| 4,037,436 | A | 7/1977 | Wehrmann | |
| 4,180,065 | A | 12/1979 | Bowen | |
| 4,341,096 | A | 7/1982 | Safrit et al. | |
| 4,373,215 | A | 2/1983 | Guigley | |
| 4,373,361 | A | 2/1983 | Thorneburg | |
| 4,467,626 | A | 8/1984 | Coble et al. | |
| 4,571,960 | A | 2/1986 | Hursh et al. | |
| 4,615,188 | A | 10/1986 | Hursh et al. | |
| 4,630,455 | A | 12/1986 | Lingenfelter | |
| 4,669,126 | A | 6/1987 | Jones | |
| 4,843,844 | A | 7/1989 | Hursh et al. | |
| 4,958,507 | A | 9/1990 | Allaire et al. | |
| 5,020,164 | A * | 6/1991 | Edwards | A41B 11/00 2/239 |
| 5,133,091 | A | 7/1992 | del Valle Mas | |
| 5,157,791 | A | 10/1992 | Woodson et al. | |
| 5,325,541 | A | 7/1994 | Willard | |
| 5,421,034 | A | 6/1995 | Keune | |
| 5,473,781 | A | 12/1995 | Greenberg | |
| 5,509,282 | A | 4/1996 | Ferrell, Jr. | |
| 5,581,817 | A | 12/1996 | Hicks | |
| 5,617,745 | A | 4/1997 | Della Corte et al. | |
| 5,675,992 | A | 10/1997 | Wrightenberry | |
| 5,778,702 | A | 7/1998 | Wrightenberry | |
| 5,784,721 | A * | 7/1998 | Huff | A41B 11/02 2/239 |
| 5,946,731 | A | 9/1999 | Finlay et al. | |
| 6,108,820 | A | 8/2000 | Bernhardt | |
| 6,158,254 | A | 12/2000 | Richard | |
| 6,415,448 | B1 | 7/2002 | Glogover | |
| 6,564,392 | B1 | 5/2003 | Buckwald | |
| 6,612,136 | B2 | 9/2003 | Roe | |
| 6,651,257 | B2 | 11/2003 | Smith | |
| 6,688,142 | B2 | 2/2004 | Higgins | |
| 6,862,902 | B1 | 3/2005 | Kim | |
| 6,978,643 | B2 * | 12/2005 | Akers | F16L 59/029 66/170 |
| 7,213,420 | B2 | 5/2007 | Lynch et al. | |
| 7,533,424 | B2 | 5/2009 | Symonds-Powell | |
| 7,669,252 | B2 | 3/2010 | Wei | |
| 9,365,960 | B2 * | 6/2016 | Craig | A41B 11/005 |
| 2002/0017358 | A1 * | 2/2002 | Williams | A41B 11/00 156/156 |
| 2002/0023288 | A1 | 2/2002 | Garneau | |
| 2002/0029405 | A1 | 3/2002 | Outwater | |
| 2002/0083511 | A1 | 7/2002 | Glogover | |
| 2003/0089136 | A1 | 5/2003 | Lynch et al. | |
| 2005/0155137 | A1 | 7/2005 | Berger | |
| 2007/0163145 | A1 | 7/2007 | Lavers | |
| 2008/0034477 | A1 | 2/2008 | Symonds-Powell | |
| 2008/0092275 | A1 | 4/2008 | Wei | |
| 2009/0151051 | A1 | 6/2009 | Chen | |
| 2009/0193567 | A1 | 8/2009 | Treptow et al. | |
| 2010/0050320 | A1 | 3/2010 | Canci | |
| 2012/0124717 | A1 | 5/2012 | Austin | |
| 2012/0266362 | A1 | 10/2012 | Craig | |
| 2014/0345033 | A1 * | 11/2014 | Chang | A41B 11/005 2/239 |
| 2015/0096106 | A1 * | 4/2015 | Bell | A41B 11/006 2/239 |
| 2016/0150830 | A1 * | 6/2016 | Serrano-Wu | A63B 71/1225 2/239 |
| 2016/0278441 | A1 | 9/2016 | Craig | |
| 2018/0020742 | A1 * | 1/2018 | Johnson | A41B 11/06 2/239 |
| 2018/0332920 | A1 * | 11/2018 | Burch | A43B 13/40 |

FOREIGN PATENT DOCUMENTS

| | | | |
|---|---|---|---|
| JP | 9-291402 | A | 11/1997 |
| JP | 11-12802 | A | 1/1999 |
| JP | 2001-234401 | A | 8/2001 |
| JP | 2004-246927 | A | 9/2004 |
| WO | 2007/099261 | A2 | 9/2007 |

OTHER PUBLICATIONS

European Search Report received for European Patent Application No. 16192859.3, dated May 14, 2020, 7 pages.

Office Action received for European Patent Application No. 16192859.3, dated Sep. 22, 2021, 9 pages.

* cited by examiner

SOCK WITH ZONES OF VARYING LAYERS

CROSS-REFERENCE TO RELATED APPLICATION

This U.S. application Ser. No. 16/812,007, filed on Mar. 6, 2020, and entitled "Sock With Zones Of Varying Layers," is a Continuation Application of U.S. application Ser. No. 15/178,867, filed on Jun. 10, 2016, entitled "Sock With Zones Of Varying Layers," which issued as U.S. Pat. No. 10,624,395 on Apr. 21, 2020, which is in turn a Divisional Application of U.S. application Ser. No. 13/030,813, filed on Apr. 20, 2011, entitled "Sock With Zones Of Varying Layers," which issued as U.S. Pat. No. 9,365,960 on Jun. 14, 2016. The entireties of the aforementioned applications are incorporated by reference herein.

BACKGROUND OF THE INVENTION

1. Field of the Invention

The present disclosure generally relates to a sock with multiple zones made up of varying numbers of layers of material. More particularly, the present disclosure relates to a sock including at least a first zone made of two layers of material adjacent to a second zone made of a single layer of material.

2. Description of Related Art

Athletes, as well as casual shoe wearers, may wear more than one pair of socks simultaneously for a variety of reasons. Namely, a wearer may layer one pair of socks on top of another pair of socks. Some benefits of wearing two pairs of socks simultaneously may include: additional cushioning, reduced incidence of blistering, increased warmth, and additional capacity for absorbing perspiration. In particular, wearing two socks at the same time allows for movement between the inner sock and the outer sock, thereby decreasing movement between an inner sock and a wearer's foot that might causing blistering or other discomfort.

However, wearing more than one pair of socks may also be inconvenient for other reasons. For example, poor ventilation may cause athlete's foot or a disagreeable odor if the multiple socks are worn for long periods of time. Further, two or more seams may overlap in the same position on a wearer's foot, thereby causing abrasion. Specifically, overlapping seams at the toe closures of each sock can cause pressure on the toes, which may result in peeling of the wearer's skin.

For these reasons, a variety of double layer socks are known in the art. These double layer socks seek to provide the advantages of wearing two distinct socks in one convenient article. Some of these dual layer socks are formed by knitting two socks separately, putting one sock into the other, and sewing the socks together at the ankle area. Other double layer socks such as the socks disclosed in U.S. Pat. No. 6,862,902 to Kim, the disclosure of which is hereby incorporated in its entirely, are formed by continuous knitting of an outer layer and an inner layer, and then sewing the layers together at the toe closure.

Unfortunately, these currently known arrangements have their own shortcomings. If the toe parts of the inner and outer socks are not attached to each other, the inner and outer layers of the socks may move independently of each other. In some cases, the inner socks may become bunched at the toes or stuck between the toes of the wearer. Further, the procedure of inserting the inner socks into the outer socks and aligning the two socks with each other is complex and time-consuming, increasing manufacturing costs.

There is a need in the art for a sock, the wearing of which provides the same advantages as wearing two pairs of socks, but that does not include the shortcomings of wearing two pairs of socks or of currently available dual layer socks as discussed above.

SUMMARY OF THE INVENTION

This disclosure generally provides a sock and a method for manufacturing the sock.

In a first aspect, this disclosure provides a sock with zones of varying numbers of layers of material, the sock comprising: a first zone, the first zone surrounding the circumference of the sock and extending axially along a length of the sock from a first end of the sock to a first zone division line; the first zone having an inner layer of material and an outer layer of material; a second zone adjacent to the first zone, the second zone surrounding the circumference of the sock and extending axially along the length of the sock from the zone division line in a direction away from the first zone; and the second zone having a single layer of material.

In another aspect, this disclosure provides a sock with zones of varying numbers of layers of materials, the sock being formed by: knitting a sock blank in the form of a single continuous tube of material; the sock blank including: a first heel and ankle portion, the first heel and ankle portion extending from a first end of the sock blank to a heel end fold line; a second heel and ankle portion, the second heel and ankle portion being adjacent to the first heel and ankle portion, and extending from the heel end fold line to a first zone division line; a midfoot portion, the midfoot region extending from the first zone division line to a second zone division line; a first toe portion, the first toe portion extending from the second zone division line to a toe end fold line; and a second toe portion, the second toe portion extending from the toe end fold line to a second end of the sock blank; forming a double-layer first zone of the sock by folding the first heel and ankle portion at the heel end fold line so as to be coextensive with the second heel and ankle portion, such that the first heel and ankle portion corresponds to a first layer of the sock in the first zone and the second heel and ankle portion corresponds to a second layer of the sock in the first zone; the portion of the sock located between the first zone division line and the second zone division line being a single-layer second zone of the sock; and forming a double-layer third zone of the sock by folding the second toe portion at the toe end fold line so as to be coextensive with the first toe portion, such that the second toe portion corresponds to a first layer of the sock in the second zone and the first toe portion corresponds to a second layer of the sock in the second zone.

In yet another aspect, the present disclosure provides a method for fabricating a sock with zones of varying numbers of layers of material, the method comprising: knitting a sock blank in the form of a single continuous tube of material on a circular knitting machine, the sock blank being symmetric about a first fold line from a first end of the sock blank to a first zone division line; folding a first portion of the sock blank at the first fold line so as to be coextensive with a second portion of the sock blank, the first portion extending from the first end of the sock blank to the first fold line, the second portion extending from the first fold line to the first zone division line; whereby the first portion of the sock blank corresponds to a first layer of the sock in a first zone of the sock and the second portion of the sock blank corresponds to a second layer of the sock in the first zone; and attaching the first end of the sock blank to the second portion of the sock blank at the first zone division line, the first zone division line being located a predetermined distance away from a second end of the sock blank.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Preferred embodiments are described in detail below by referring to the accompanying drawings to manifest the characteristic features of the socks with zones of varying numbers of layers and the method for producing the same according to this disclosure.

Generally, this disclosure relates to socks that include both double layers and single layers. Each sock may include a double layer first zone, and a single layer second zone. The double layer first zone may provide increased cushioning and friction abetment, while the single layer second zone may allow for better evaporation of perspiration.

As used herein, descriptors such as "first" and "second" are used in a relative manner, to distinguish one feature of the disclosure from another. Accordingly, a feature described as the "first" aspect with respect to a "second" aspect in one embodiment may also be described as the "second" aspect with respect to a "third" aspect in another embodiment, and so on accordingly.

Figure 1:
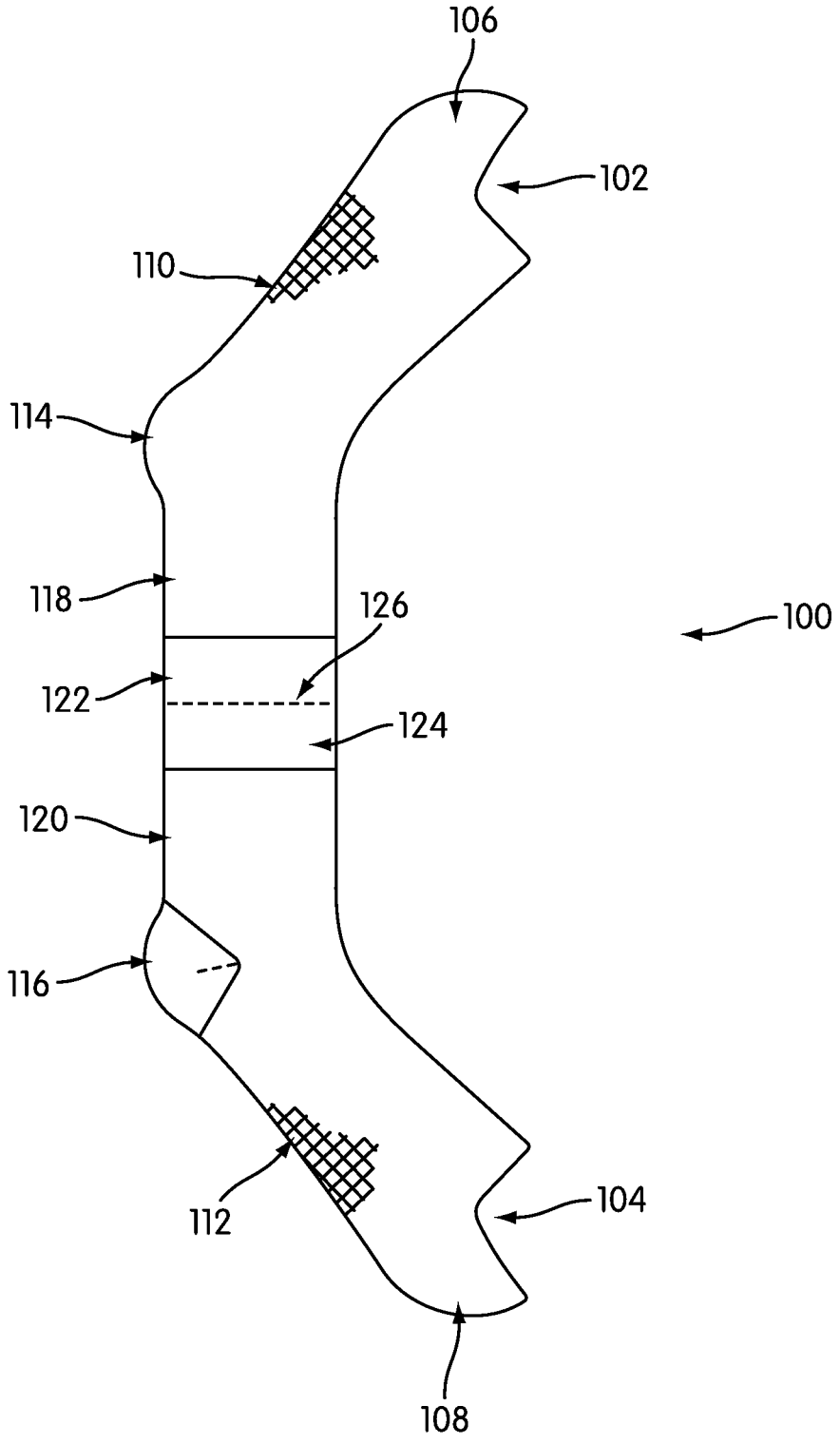
FIG. 1 PRIOR ART
FIG. 1 is a prior art sock blank that forms a double-layer sock.

FIG. 1 shows a prior art sock blank 100. This sock blank is discussed in U.S. Pat. No. 6,862,902 to Kim, the disclosure of which is hereby incorporated in its entirety. Briefly, sock blank 100 is entirely symmetric about a fold line 126. Sock blank 100 includes a first toe end opening 102 at a first end 106, a first midfoot portion 110, a first heel portion 114, a first ankle portion 118, and a first leg portion 122. Each of these portions above fold line 126 corresponds to an equivalent portion below fold line 126. Namely, sock blank 100 further includes a second toe end opening 104 at second end 108, second midfoot portion 112, second heel portion 116, second ankle portion 120 and second leg portion 124. A sock is manufactured from sock blank 100 by folding sock blank 100 back on itself at fold line 126 so that each of the first portions is coextensive with the corresponding second portion. As a result, the sock manufactured from sock blank 100 is double layered throughout its entirety.

Figure 2:
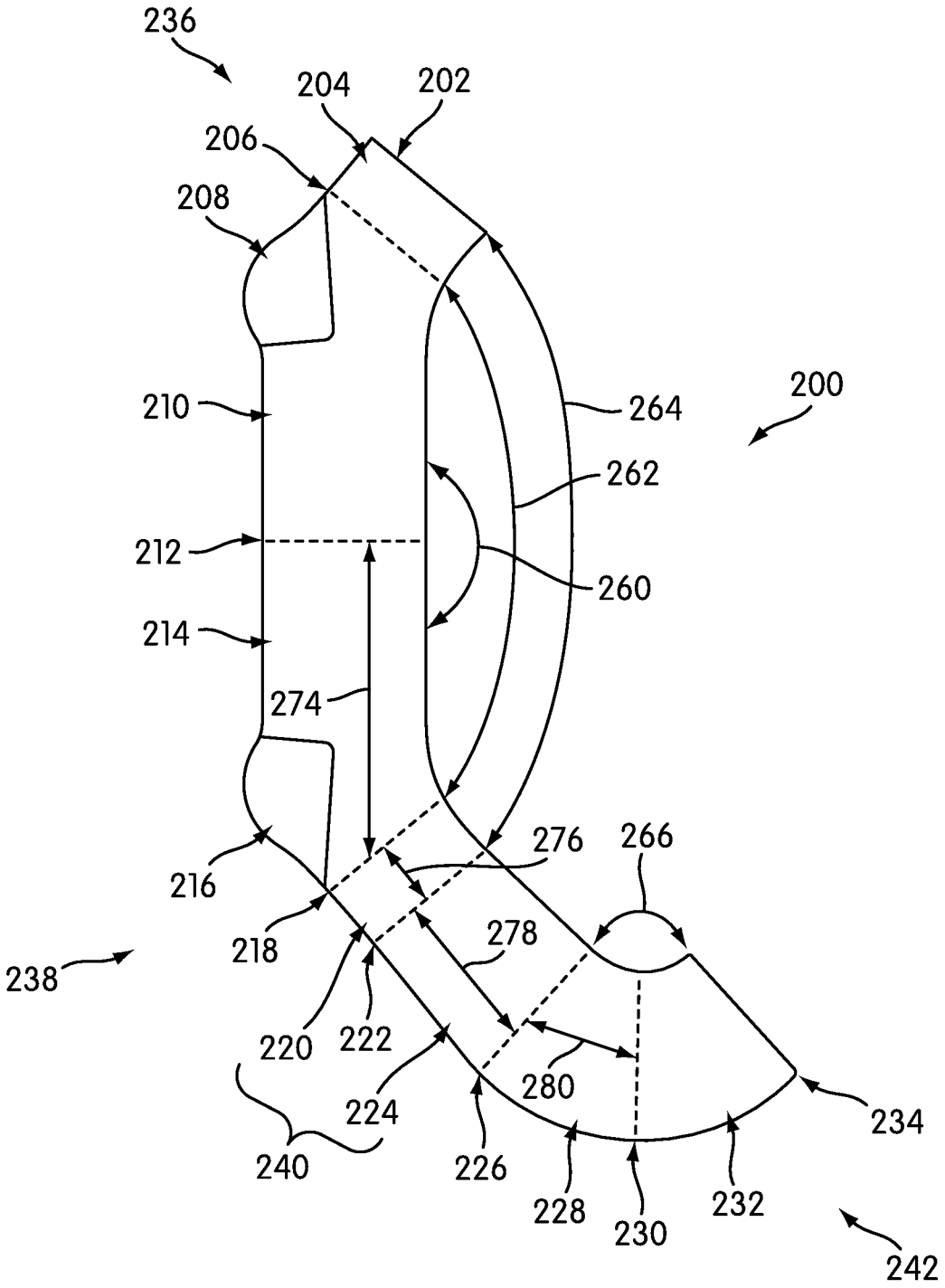
FIG. 2 is a first embodiment of a sock blank in accordance with this disclosure.

FIG. 2 shows a first embodiment of a sock blank 200 in accordance with this disclosure. Sock blank 200 is a continuous tube of material, and may be used to manufacture a sock having zones of varying numbers of layers, as described below. FIG. 2 shows a two dimensional projection of the three dimensional cylinder-type shape that is the tube constituting sock blank 200. Sock blank may be continuously knit on a circular kitting machine, as is known in the art of sock manufacturing.

Sock blank 200 is symmetric with itself in two ways. First, sock blank 200 is symmetric about a first fold line 212 between a first end 202 of sock blank 200 and a first zone division line 222. Second, sock blank 200 is symmetric about a second fold line 230 between a second end 234 of sock blank 200 and a second zone division line 226. In certain embodiments, these symmetries allow the sock manufactured from sock blank 200 to achieve zones of two layers of material separated by a zone of a single layer of material.

With respect to the first symmetry, sock blank 200 includes a first portion 236 between first end 202 and first fold line 212, and a second portion 238 between first fold line 212 and first zone division line 222. First portion 236 includes first end 202, first arch portion 204, first heel division line 206, first heel portion 208, and first ankle portion 210. Second portion 238 includes second ankle portion 214, second heel portion 216, second heel division line 218, and second arch portion 220.

In certain embodiments, first portion 236 may also be referred to as a first heel and ankle portion, just as second portion 238 may also be referred to as a second heel and ankle portion. Similarly, in certain embodiments, first fold line 212 may also be referred to as a heel end fold line.

Each part of first portion 236 corresponds to a symmetric part of second portion 238, as shown by the several arrows in FIG. 2. Specifically, first end 202 may be aligned with first zone division line 222 as shown by arrow 264, so that each part of first portion 236 may be coextensive with each part of second portion 238. In this way, first arch portion 204 may align with second arch portion 220, first heel division line 206 may align with second heel division line 218 as shown by arrow 262, and first heel portion 208 may align with second ankle portion 214 as shown by arrow 260.

The overall dimensions of first portion 236 and second portion 238 may generally be any dimensions suitable to forming a sock. These dimensions may be defined by arrow 274 and arrow 276, as shown in FIG. 2. Specifically, arrow 274 shows a distance between first fold line 212 and second heel division line 218. This distance may vary depending on the purpose for which the sock is designed. For example, a running sock may have a shorter distance 274, while a soccer sock may have a longer distance 274. As sock blank 200 is symmetric about first fold line 212, distance 274 may be the same between first fold line 212 and second heel division line 218 as it is between first fold line 212 and first heel division line 206.

Similarly, arrow 276 measures a distance between second heel division line 218 and first zone division line 222. Distance 276 may vary depending on how much of a wearer's arch is to be encompassed by a double layer zone of the sock manufactured from sock blank 200. Namely, if the sock is designed to encompass the entirety of a wearer's arch in a double layer zone then distance 276 may be relatively longer. On the other hand, if the sock is designed to minimize the amount of a wearer's arch that is encompassed by a double layer zone, then distance 276 may be relatively shorter or even non-existent. In embodiments where distance 276 is negligible or non-existent, then second heel division line 218 may correspond to first zone division line 222. Again due to the symmetry, distance 276 is the same between second heel division line 218 and first zone division line 222 as it is between first end 202 and first heel division line 206.

Sock blank 200 further includes a third portion 224. As shown in FIG. 2, third portion 224 may correspond to a midfoot portion. In certain embodiments, third portion 224 is not symmetric with any other portion of sock blank 200. Third portion 224 may extend from first zone division line 222 to second zone division line 226. Third portion 224 may have a length 278. Length 278 may generally be any length appropriate for a sock. Length 278 may correspond to an amount of a sock manufactured from sock blank 200 that is single layered.

With respect to the second symmetry, sock blank 200 may include a fourth portion 228 and a fifth portion 232. Fourth portion 228 may extend from second zone division line 226 to second fold line 230, and in some embodiments may also be referred to as a first toe portion. Fifth portion 232 may extend from second fold line 230 to second end 234 of sock blank 200, and in some embodiments may be referred to as a second toe portion. Fourth portion 228 and fifth portion 232 may be symmetric, as shown by arrow 266. Namely, second end 234 of sock blank 200 may be folded so as to align with second zone division line 226.

Each of fourth portion 228 and fifth portion 232 may have length 280, as shown in FIG. 2 with respect to fourth portion 228. Length 280 may correspond to the length of a wearer's toes that are encompassed by a double layer zone, and may generally be any length that is appropriate to sock manufacturing.

Figure 3:
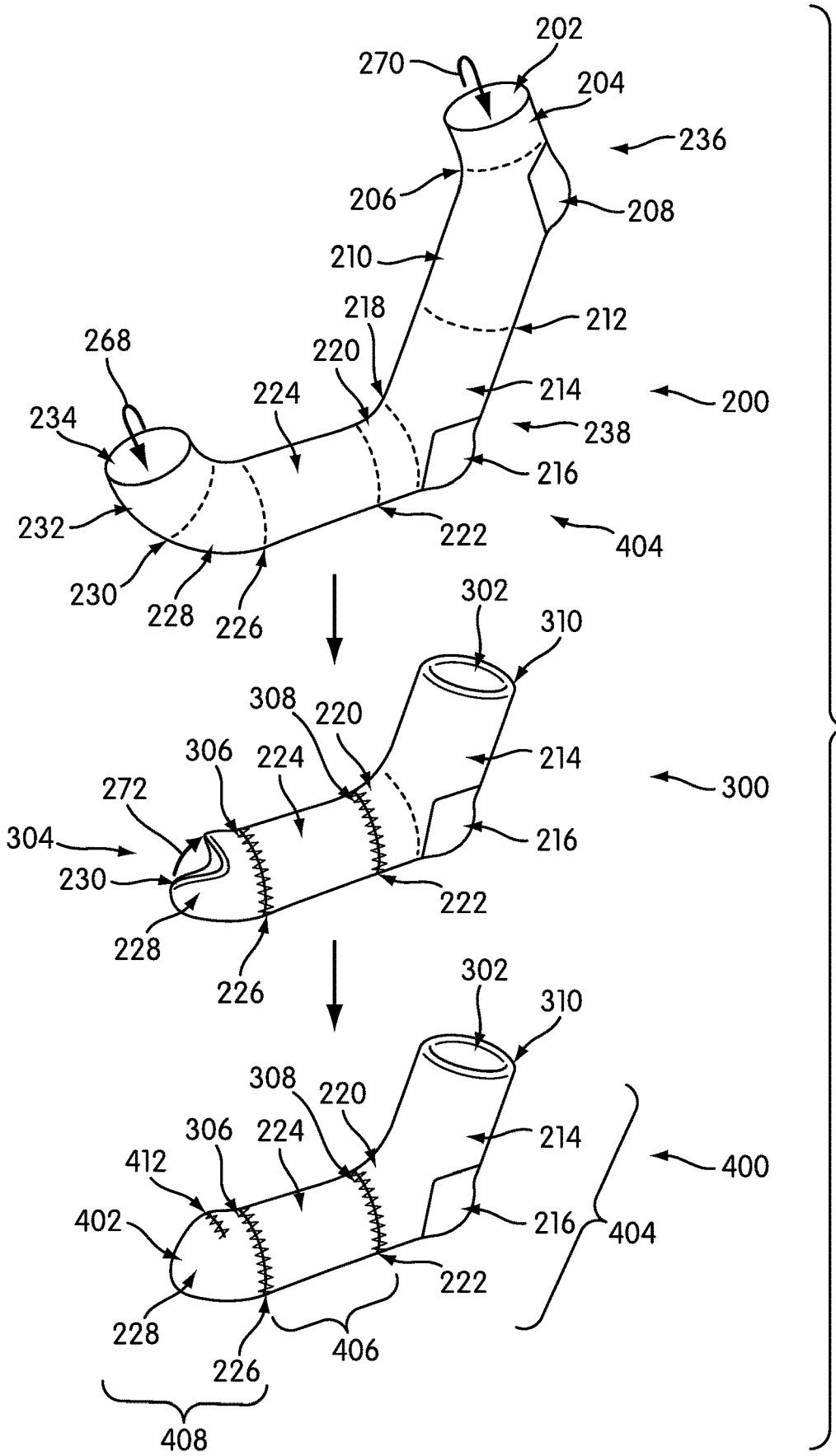
FIG. 3 shows three views of a method by which the sock blank of FIG. 2 is manufactured into a first embodiments of a sock.

FIG. 3 shows an isometric view of three stages by which sock blank 200 is manufactured into finished sock 400. FIG. 3 therefore shows both the physical arrangement of the finished sock 400 with respect to the sock blank 200, and also a method for manufacturing sock 400.

First, sock blank 200 is shown as a tube, having first end 202 and second end 234 that are each open. The various components of sock blank 200 shown in FIG. 3 correspond to the same components as numbered in FIG. 2 and discussed above. In a first step, each end of sock blank 200 is folded at a fold line so as to be coextensive with remaining portions of sock blank 200.

Specifically, first end 202 is folded back into the tube of sock blank 200 as shown by arrow 270. This folding back into itself continues until first portion 236 is folded at fold line 212 so as to be coextensive with second portion 238. Although in the embodiment shown in FIG. 3, first portion 236 is folded into second portion 238, in other embodiments first portion 236 may be folded on top of second portion 238 as discussed below with respect to FIG. 9.

Similarly, second end 234 is folded back into the tube of sock blank 200 as shown by arrow 268. This folding back into itself continues until fifth portion 232 is folded at fold line 230 so as to be coextensive with fourth portion 228. Although in the embodiment shown in FIG. 3, fifth portion 232 is folded into fourth portion 228, in other embodiments fifth portion 232 may be folded on top of fourth portion 230 as discussed below with respect to FIG. 9.

As a result of these folds, intermediate pre-sock 300 may be formed. A first end 302 of intermediate pre-sock 300 may be formed at first fold line 212. First end 302 may be created where first ankle portion 210 doubles back on second ankle portion 214 as denoted by 310. A second end 304 of intermediate pre-sock 300 may then be formed at second fold line 230. Second end 304 may be created where fifth portion 232 doubles back on fourth portion 230.

Once these folds have been formed, each end of sock blank 200 may be attached to the portion not folded at a zone division line. These attachments form bonds between the material so folded and the rest of the intermediate pre-sock 300. Namely, first end 202 may be attached to second heel portion 220 at first zone division line 222 as shown by 308. Second end 234 may be attached to fourth portion 228 at second zone division line 226 as shown by 306. The attachment may be in the form of stitching, knitting, fastening, hook-and-loop joining, or other attachment mechanism as may be known in the art of sock manufacturing. In some embodiments, the attachment may be a fixed attachment that is permanent, such as stitching. In other embodiments, the attachment may be a reversible attachment such as a hook-and-loop attachment (also commonly referred to as Velcro™).

After each end of sock blank 200 are attached, second fold line 230 may be folded onto itself as indicated by arrow 272. Finished sock 400 is then created by attaching this material together so as to create a closed toe end 402 of sock 400. Attachment 412 may be in the form of stitching, or other attachment as described above. Finished sock 400 therefore includes three zones: a first zone 404 extending from first end 302 of the finished sock to first zone division line 222 where attachment 308 is located, a second zone 406 between first zone division line 222 and second zone division line 226 where attachment 306 is located, and a third zone 408 extending from second zone division line 226 to second end 402 of sock 400.

Figure 4:
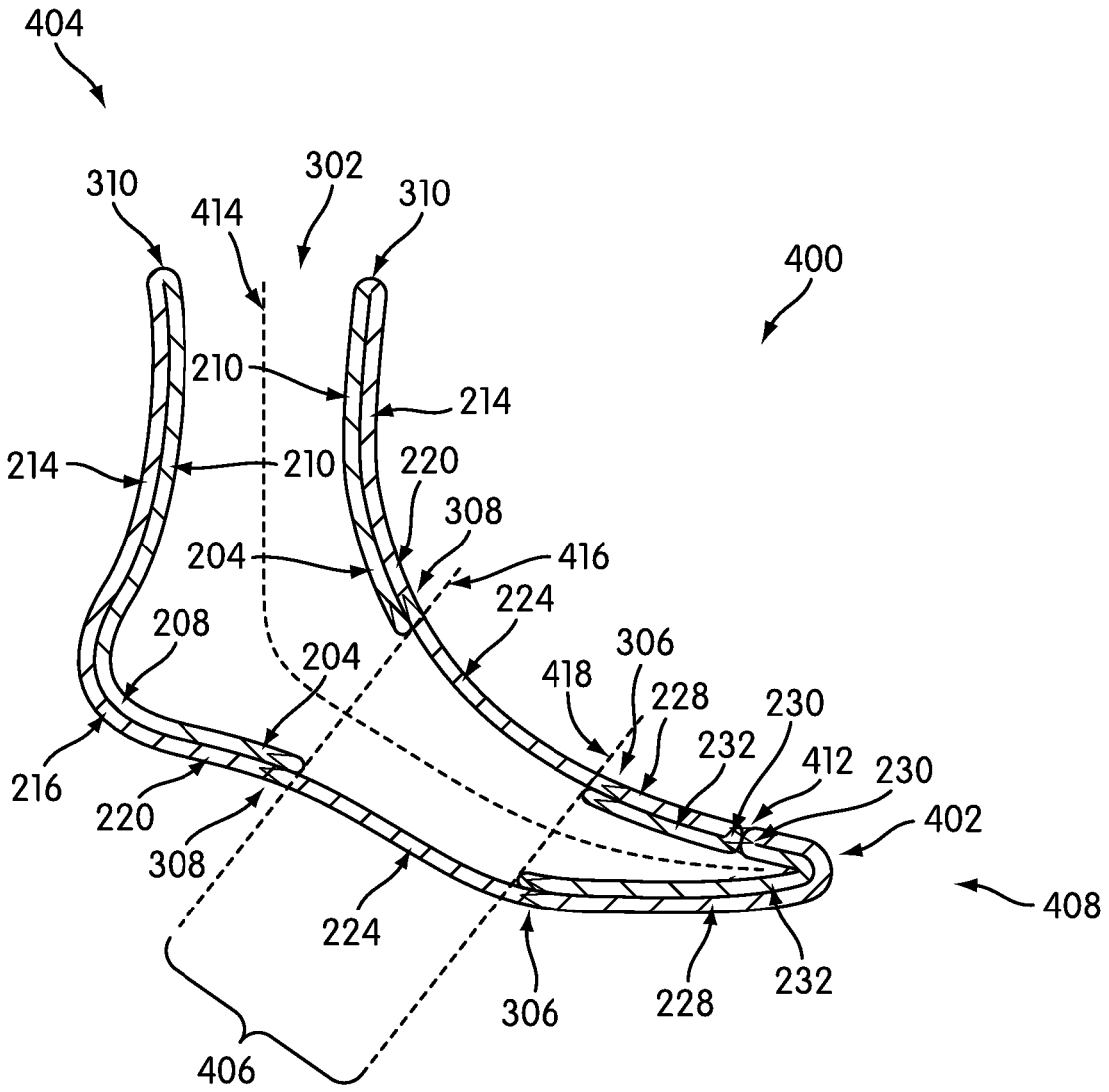
FIG. 4 is a cross-sectional view of a first embodiment of a sock.

FIG. 4 shows a cross-sectional view of finished sock 400. This cross-section shows how certain zones of the sock include double layers, while another includes only a single layer. Each zone may be surround the circumference of the sock, and extend axially along axis 414 along a length of the sock.

Specifically, first zone 404 may include an outer layer made up of second ankle portion 214, second heel portion 216, and second arch portion 220. First zone 404 further may include an inner layer made up of first ankle portion 210, first heel portion 208, and a first arch portion 204. The inner layer may be continuous with the outer layer at fold 310, which may correspond to first fold line 212. First zone 404 may therefore be a double layered zone of sock 400. The inner layer and the outer layer may be connected at two locations: at fold 310 and at attachment 308. These anchor points of connectivity may prevent the inner layer from twisting or bunching with respect to the outer layer.

First zone 404 may be separated from a second zone 406 at first zone division line 416. First zone division line 416 on sock 400 may correspond to first zone division line 222 on sock blank 200. Second zone 406 may be single layered. Here, the single layer of material may correspond to third portion 224 of sock blank 200. Second zone 406 may extend from first zone division line 416 to second zone division line 418. Second zone division line 418 on sock 400 may correspond to second zone division line 226 on sock blank 200.

Third zone 408 in sock 400 may then extend from second zone division line 418 to second end 402 of sock 400. Third zone 408 may be double layered. Specifically, third zone 408 may include an outer layer made up of fourth portion 228 of sock blank 200 and an inner layer made up of fifth portion 232 of sock blank 200.

The inner layer of the third zone may be connected to the outer layer of the third zone at two places: at fold 230 where fourth portion 228 is continuous with fifth portion 232, and at attachment 306. As in first zone 404, these two connections may prevent the inner layer of the third zone from twisting and bunching with respect to the outer layer of the third zone.

As a result of the above discussed configuration of sock 400, sock 400 may provide increased cushioning and decreased friction in first zone 404 and third zone 408. These advantages of double layered socks are achieved while also preventing twisting or bunching, due to the multiple points of connectivity between each inner layer and each outer layer. Simultaneously, sock 400 may also provide increased perspiration evaporation in second zone 406 as a result of the single layer therein. Sock 400 may therefore achieve the advantages of using dual or double layered sock without the drawbacks. Furthermore, as each of the inner layers and outer layers may be formed from a single continuous tube sock blank 200, sock 400 may be efficiently and economically manufactured without the need to attach separately knit components together.

Figure 5:
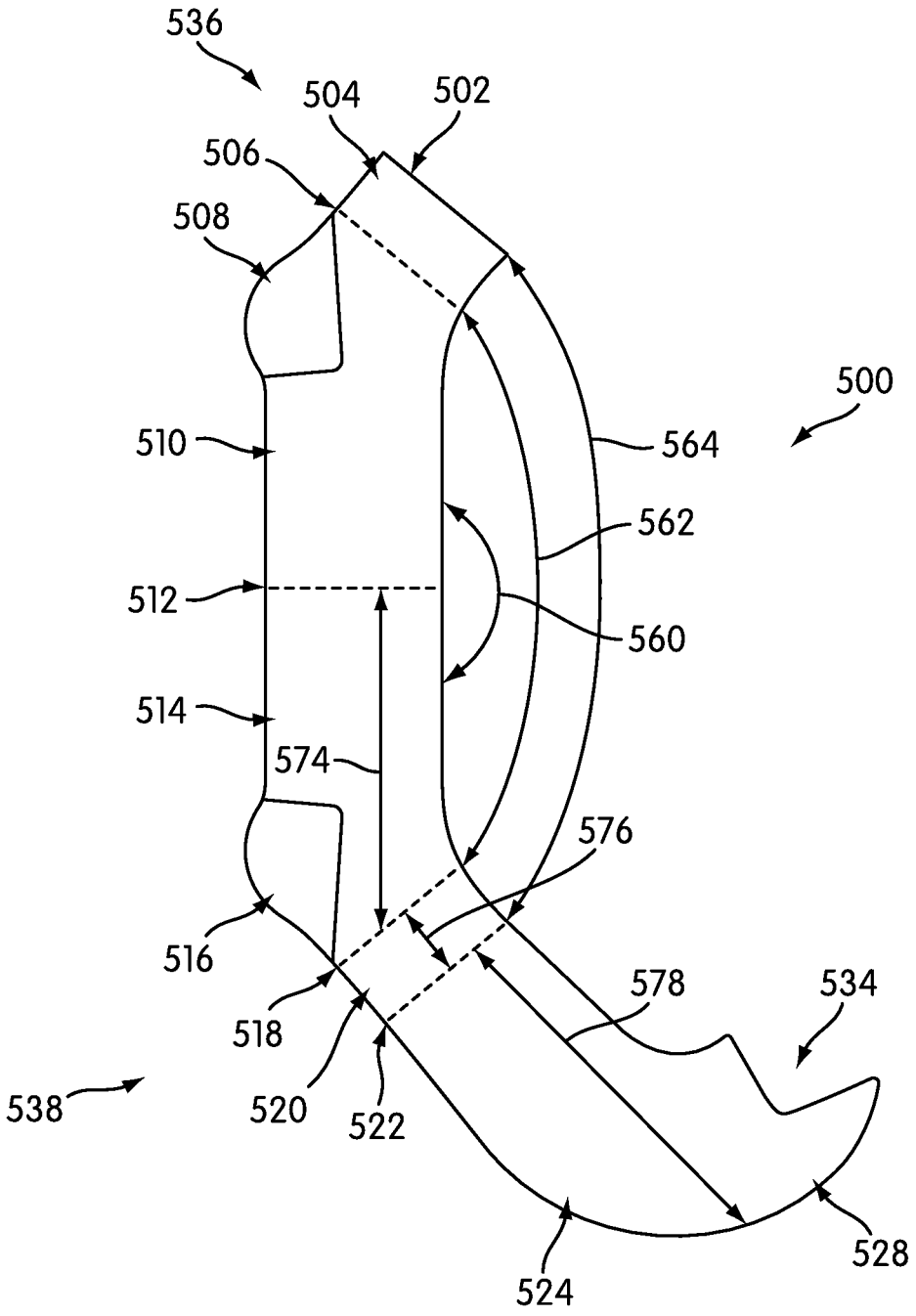
FIG. 5 is a second embodiment of a sock blank.

FIG. 5 shows a second embodiment of a sock blank 500 Sock blank 500 may be similar to sock blank 200 shown in FIG. 2 with respect to its first end, but differ with respect to its second end. A sock manufactured from sock blank 500 may include only two zones, instead of the three zones formed from sock blank 200.

Specifically, first, sock blank 500 may include a first portion 536 that may be substantially the same as first portion 236 in sock blank 200. Namely, first portion 536 may include a first end 502 of sock blank 500, a first arch portion 504, a first heel division linen 506, a first heel portion 508, and a first ankle portion 510. First portion 536 therefore extends from first end 502 to fold line 512. Sock blank 500 may further include a second portion 538 that may be substantially similar to second portion 238 of sock blank 200. Second portion 538 may include second ankle portion 514, second heel portion 516, second heel division linen 518, and second arch portion 520. Second portion 538 therefore extends from fold line 512 to zone division line 522.

Each of first ankle portion 510 and second ankle portion 514 may have length 574, and be symmetric with each other about fold line 512 as shown by arrow 560. Each of first arch portion 504 and second arch portion 520 may have length 576, and be symmetric with each of about fold line 512 as shown by arrow 562. Thus, first end 502 may be folded back into or on top of zone division line 522, as shown by arrow 564.

Sock blank 500 also includes third portion 524. Third portion 524 may extend from zone division line 522 to second end 528 of sock blank 500. Third portion 524 may have length 578. The size of length 578 may depend on where zone division line 522 is located. In embodiments where more of a double layer zone is to encompass the wearer's foot, then zone division line 522 may be closer to second end 528 and length 578 may be relatively shorter. On the other hand, in embodiments where less of a double layer zone is to encompass the wearer's foot, then zone division line 522 may be further away from second end 528 and length 578 may be relatively longer.

Sock blank 500 differs from sock blank 200 in that sock blank 500 is only symmetric about fold line 512 from first end 502 to zone division line 522, and does not include a second symmetry. Instead, sock blank 500 includes an opening 534 that may be closed on itself to form a closed end of a sock manufactured from sock blank 500.

Figure 6:
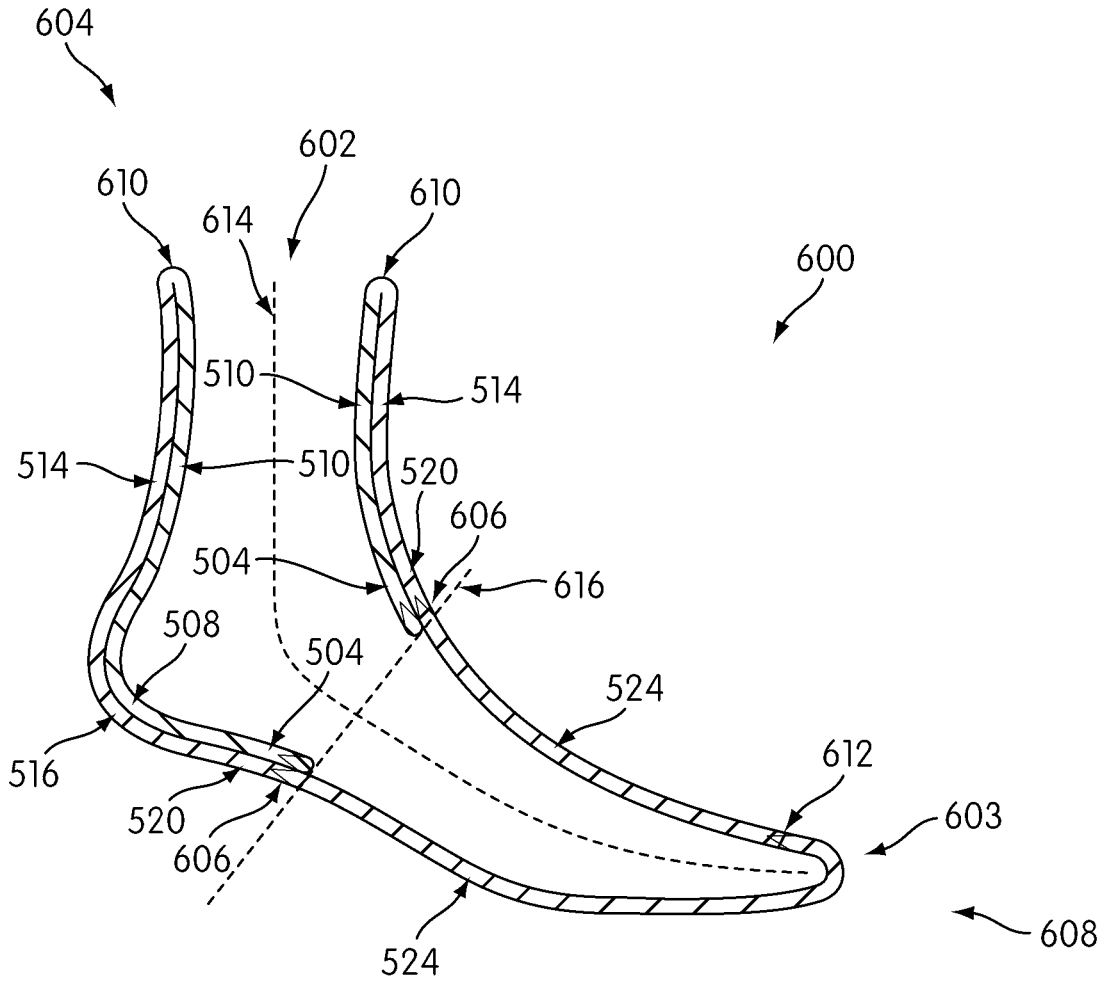
FIG. 6 is a cross-sectional view of a second embodiment of a sock, manufactured from the sock blank of FIG. 5.

FIG. 6 shows a sock 600 manufactured from sock blank 500. Sock 600 may be manufactured from sock blank 500 by folding first portion 536 so as to be coextensive with second portion 538, and then closing opening 534 to form a finished sock. Sock 600 therefore includes only a first zone 604 that is double layer and a second zone 608 that is single layer.

In particular, first zone 604 may extend axially along axis 614 from a first end 602 of sock 600 to zone division line 616. Zone division line 616 of sock 600 may correspond to zone division linen 522 of sock blank 500. First zone 604 includes an inner layer and an outer layer. Inner layer of first zone 604 may be made up of first ankle portion 510, first heel portion 508, and first arch portion 504. Outer layer of first zone 604 may be made up of second ankle portion 514, second heel portion 516, and second arch portion 520. The inner layer may be continuous with the outer layer at fold 610, which may correspond to fold line 512 of sock blank 500. The inner layer and outer layer may be attached at attachment 606. Attachment 606 may be stitching, or any other attachment mechanism as discussed above.

Second zone 608 may accordingly extend from zone division line 616 to a second end 603 of sock 600. Second zone 608 may be single layer, where the sole layer may be made up of third portion 524 of sock blank 500.

Sock 600 may therefore be manufactured through a method similar to that shown in FIG. 3, only without any second folding. Specifically, sock 600 may be manufactured by folding sock blank 500 at 512 so that first portion 536 and second portion 538 are coextensive, attaching first end 502 at attachment 606, and then closing toe end 603 at attachment 612. This embodiment of a sock may be useful when, for example, double layers are desired in the heel region but not the forefoot region of the sock. This may allow, for example, better perspiration evaporation throughout the larger single layer zone, as well as better fit to a wearer's foot.

Figure 7:
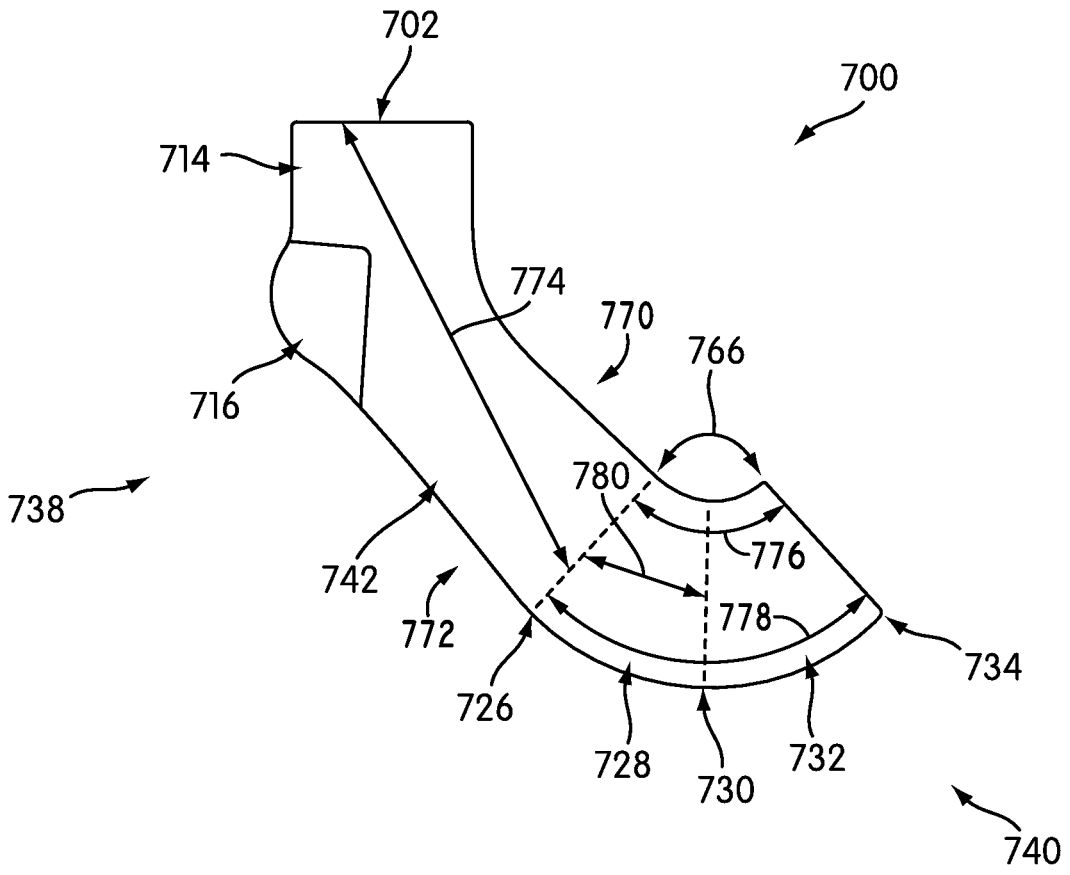
FIG. 7 is a third embodiment of a sock blank.

FIG. 7 shows yet another embodiment of a sock blank 700. Sock blank 700 is similar to sock blank 200 at its toe end 734, but different with respect to its heel end 702. Sock blank 700 may include only one fold line 730 located at a toe region, instead of any fold line located in an ankle region like first fold line 212 shown in FIG. 2 or fold line 512 shown in FIG. 5. As a result, sock blank 700 may allow for a double layer zone in the toe region and a single layer zone throughout the heel and midfoot, without any double layer zone around the heel.

Specifically, sock blank 700 includes a first portion 738 made up of first end 702, ankle portion 714 adjacent to first end 702, heel portion 716, and midfoot portion 742 continuous with heel portion 716 and ankle portion 714. Sock blank 700 may have a length 774 from first end 702 to zone division line 726. First portion 738 may considered as being similar to second portion 238 of sock blank 200, although first portion 738 may not be symmetric with any other portion of sock blank 700.

Sock blank 700 further includes second portion 728 located between zone division line 726 and fold line 730, and third portion 732 located between second end 734 and fold line 730. Second portion 728 and third portion 732 may be symmetric with each other about fold line 730, as shown by arrow 766. Thus, each may have a length 780 as measured between zone division line 736 and fold line 730, or between fold line 730 and second end 734. As discussed above the lengths 774 and 780 may vary depending on the extent to which a sock formed from sock blank 700 includes a larger or smaller double layer zone and a larger or smaller single layer zone.

Figure 8:
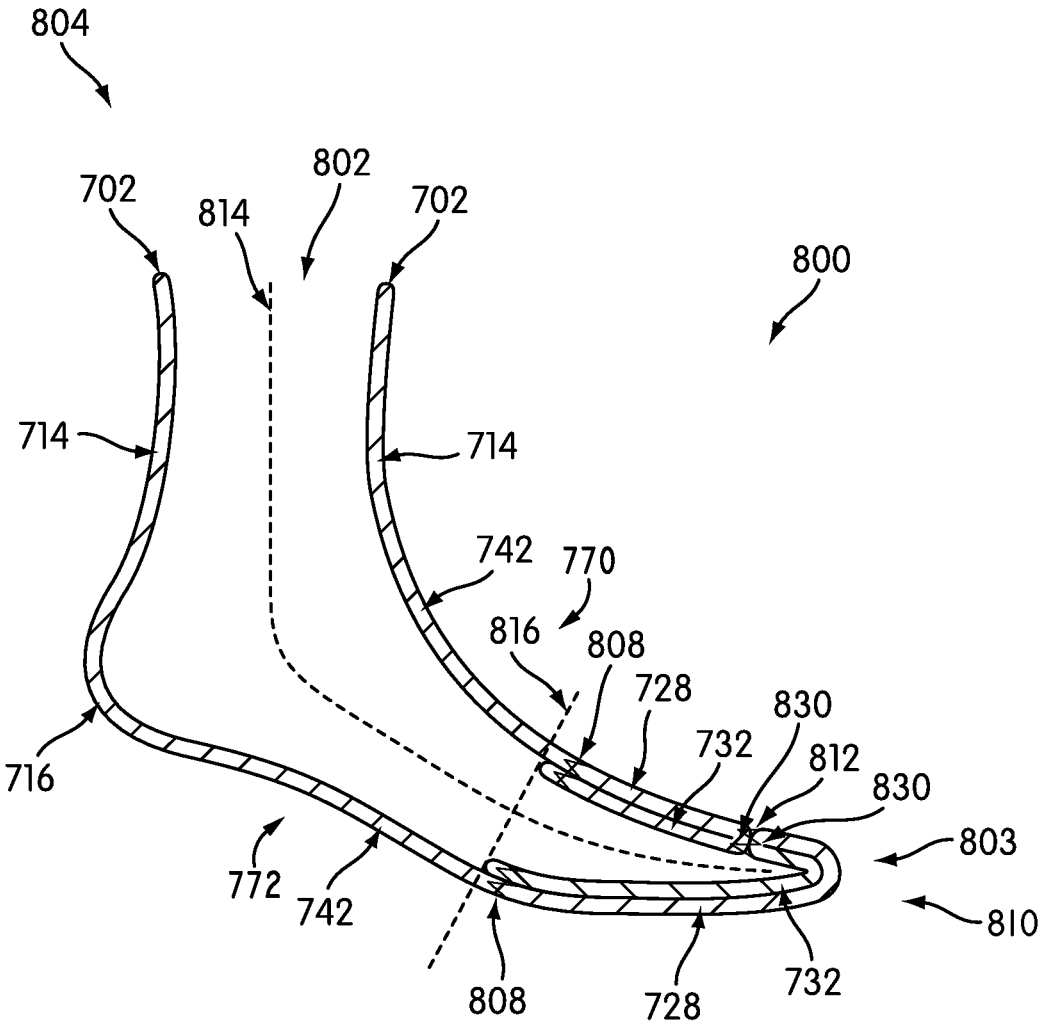
FIG. 8 is a cross-sectional view of a third embodiment of a sock, manufactured from the sock blank of FIG. 7.

FIG. 8 shows an embodiment of a sock 800 manufactured from sock blank 700. To manufacture sock 800 from sock blank 700, third portion 232 may be folded back in to or on to second portion 228 about fold line 230. Second end 734 may be attached to second portion 728 by attachment 806. Finally, toe end fold 830 may then be closed by an attachment 812, as was described with respect to FIG. 3.

Sock 800 includes a first end 802 that may be open to a wearer's foot, and a second end 803 that may be closed about a wearer's toes. First end 802 may correspond to first end 702 of sock blank 700, while second end 803 may be created by attaching folds 830 to themselves by attachment 812. As a result, sock 800 may include a first zone 804 that may be single layer. Single layer first zone 804 may extend from first end 802 of sock 800 to zone division line 816. Zone division line 816 of sock 800 may correspond to zone division line 726 of sock blank 700. The single layer in first zone 804 may be made up of ankle portion 714, heel portion 716, and midfoot portion 742.

Sock 800 may also include a double layer second zone 808. Second zone 808 may extend from zone division line 816 to second end 803 of sock 800. Second zone 808 may include an inner layer made up of third portion 732 and an outer layer made up of second portion 728. The inner layer and outer layer in second zone 808 may be connected at two anchor points. Namely, the inner layer and outer layer may be continuous at fold 830, and fixedly attached at attachment 806.

Sock 800 is therefore an embodiment where a double layer zone is present only in the toe portion of the sock, and nowhere else. This embodiment may be useful during activities or sport that might cause increased pressure and friction on the toes in particular, such as (for example) running. Sock 800 therefore achieves the advantages of double layers in the particular area of the sock where they are helpful to the wearer's needs, and allows for a single layer in other areas in order to improve fit and perspiration evaporation.

Figure 9:
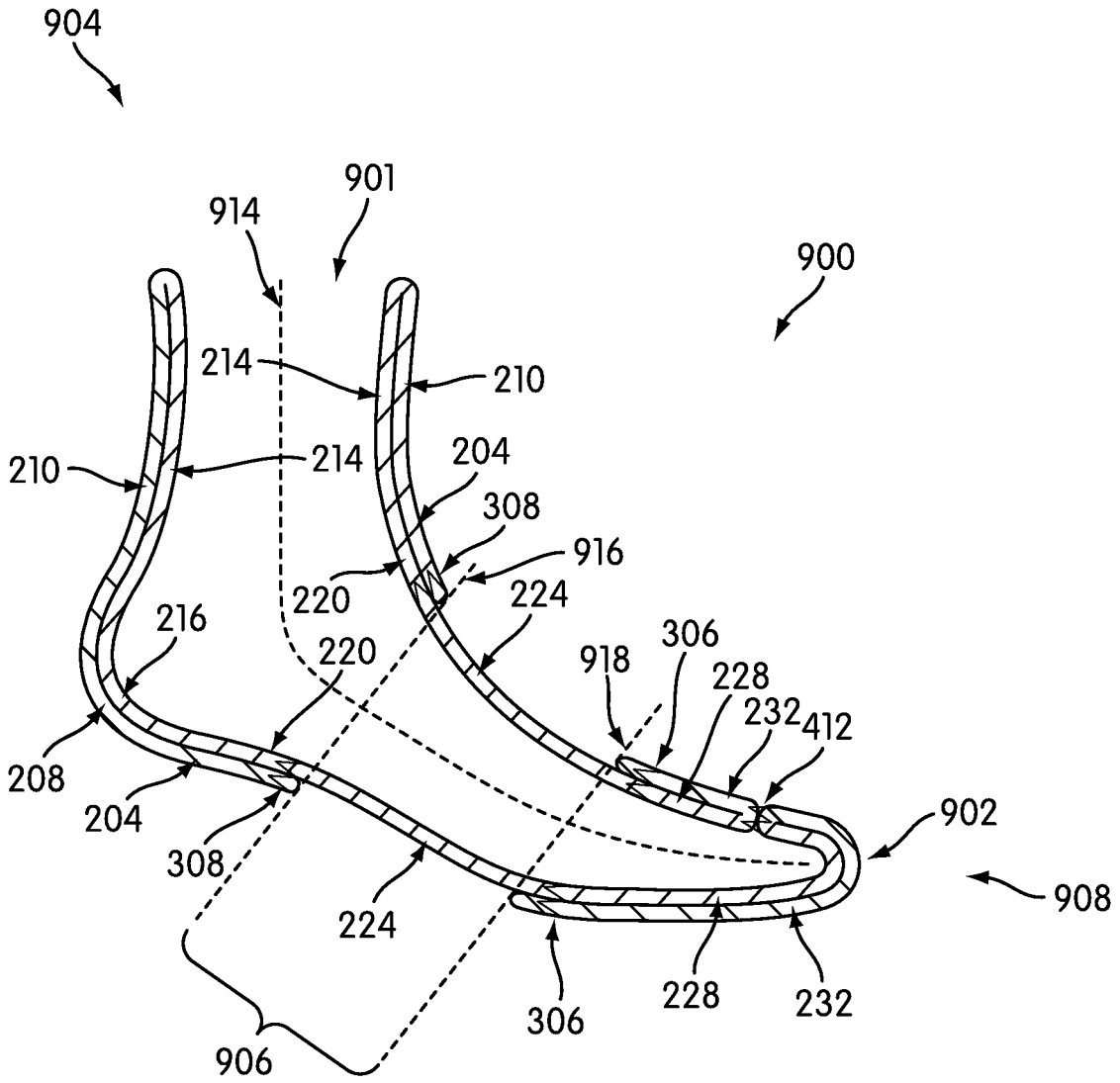
FIG. 9 is a fourth embodiment of a sock, also manufactured from the sock blank of FIG. 2.

FIG. 9 shows another embodiment of a sock 900. Sock 900 may be manufactured from sock blank 200, as shown in FIG. 2 and discussed variously above. Sock 900 differs from sock 400 with regard to the nature of the folds. In sock 400, first portion 236 is folded inside of second portion 238, and fifth portion 232 is folded inside of fourth portion 228. In contrast, the folds in sock 900 are outward. Specifically, first portion 236 is folded bank on top of second portion 238, and fifth portion 232 is folded back on top of fourth portion 228.

Sock 900 therefore includes three zones: double layer first zone 904, single layer second zone 906, and double layer third zone 908. First zone 904 extends axially along axis 914 from first end 901 of sock 900 to first zone division line 916, where first zone division line 916 may correspond to first zone division line 222 on sock blank 200. Second zone 906 extends from first zone division line 916 to second zone division line 918, where second zone division line 918 may correspond to second zone division line 226 on sock blank 200.

Sock 900 may therefore function in a similar manner as sock 400: providing advantages of double layer in both a heel region of the sock and in a toe region of the sock. The difference in folding (outward vs. inward) may be used depending on, for example, the specific requirements of a circular knitting machine or other manufacturing apparatus, or a wearer's preference. Although FIG. 9 only shows outward folds with respect to sock blank 200, it is understood that any of the sock blanks discussed herein may be folded either inward or outward to achieve the double layers.

Figure 10:
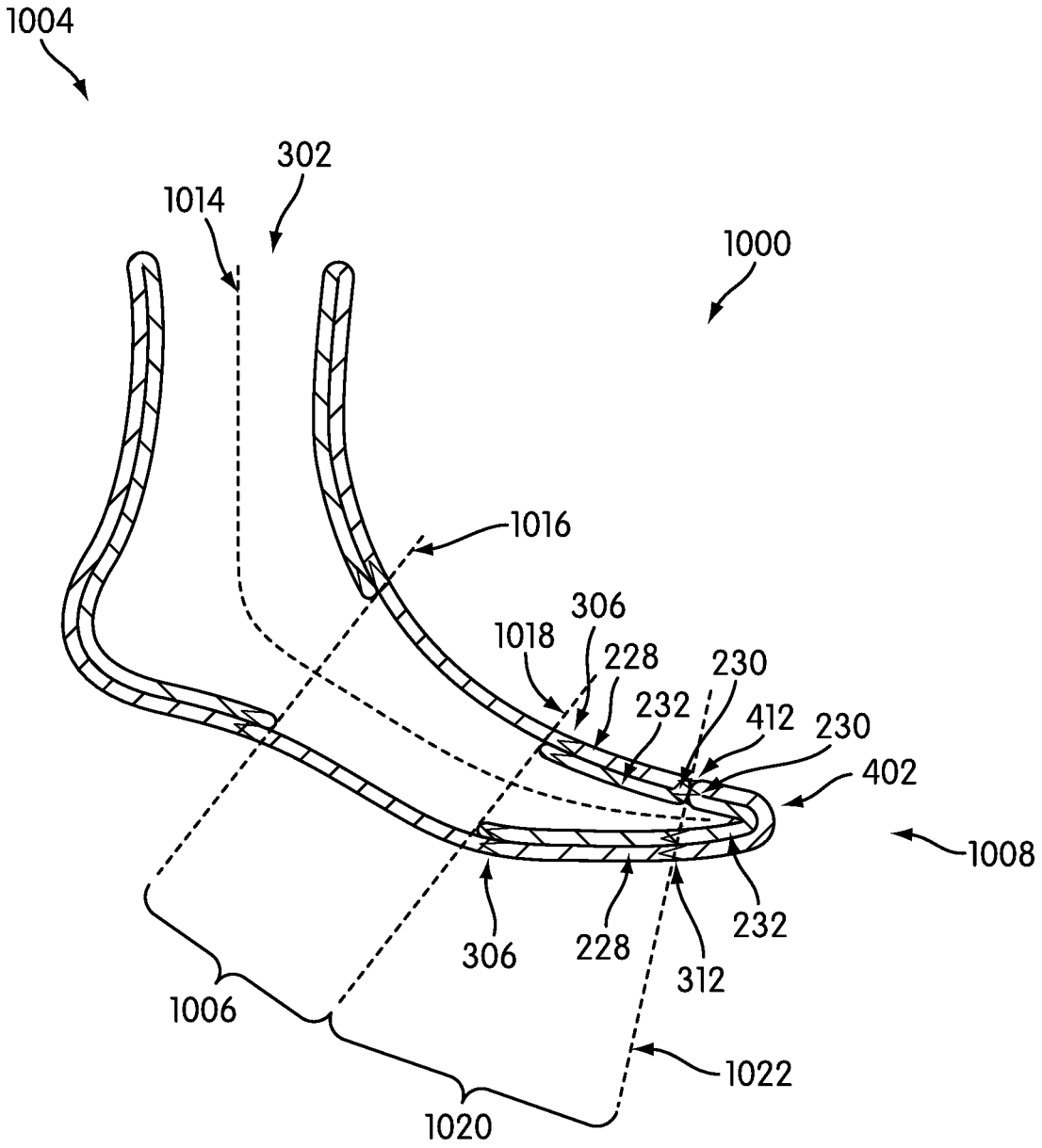
FIG. 10 is a fifth embodiment of a sock, including additional zones of anchored double layers.

FIG. 10 shows another embodiment of a sock 1000 in accordance with this disclosure. Sock 1000 may include additional zones, which may be created by additional attachments. Specifically, sock 1000 may include (1) first zone 1004 that extends along an axis 1014 of sock 1000 from first end 302 to first zone division line 1016, (2) second zone 1006 extending from first zone division line 1016 to second zone division line 1018, (3) third zone 1020 extending from second zone division line 1018 to third zone division line 1022, and finally (4) fourth zone 1008 extending from third zone division line 1022 to second end 402 of sock 1000. Attachment 312 may be located at third zone division line 1022, and may anchor inner portion 232 to outer portion 228 thereat. The separation of third zone 1020 and fourth zone 1008 may allow for inner layer 232 to move independently within each zone, without bunching up or other uncomfortable side effects.

Sock 1000, or any other sock described herein, may also have additional attachments located between any sock end and any zone division line, or between any other zone division lines. For example, one or more attachments (not pictured) may be located between first end 302 of sock 1000 and first zone division line 1006. Such attachments would thereby create further additional zones, by anchoring the inner layer to the outer layer, such that the double layers may move independently thereabout.

Figure 11:
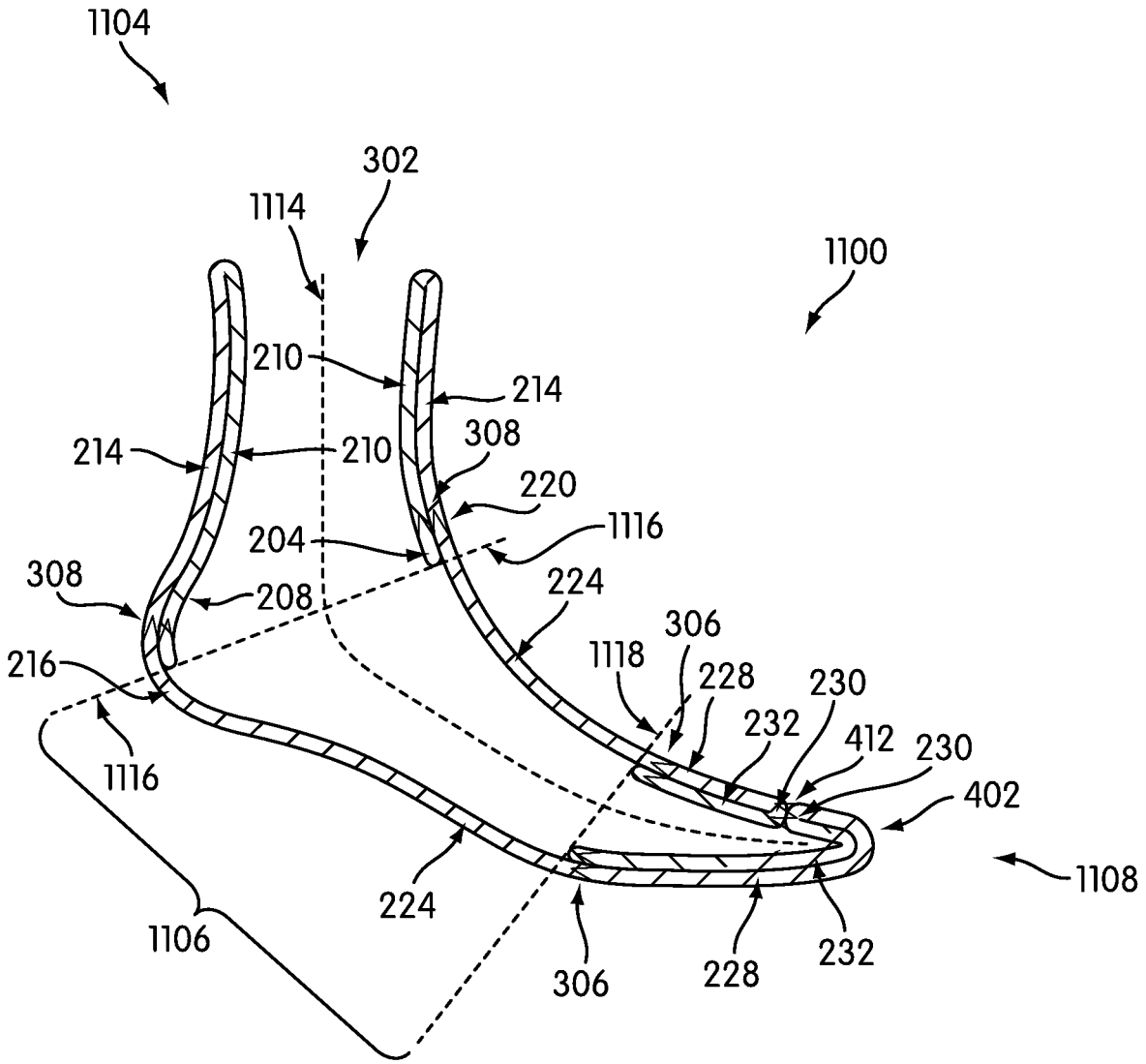
FIG. 11 is a sixth embodiment of a sock, wherein the zones are not symmetric, and the first zone division line is located midway up the heel.

FIG. 11 shows yet another embodiment of a sock 1100 in accordance with this disclosure. Sock 1100 may be substantially similar to sock 400, except that the location and orientation of first zone division line 1116 may be different from first zone division line 416 in sock 400. Specifically, first zone division line 1116 may be orientated to be substantially non-parallel with second zone division line 1118. In contrast, in other embodiments the first and second zone division lines may be substantially parallel, as seen in FIG. 4 for example. Zone division line 1116 may also be described as being non-perpendicular with respect to axis 1114 of sock 1100.

Zone division line 1116 as shown in FIG. 11 may be created by changing the shape of inner portion 204 to be longer on one side than the other. As a result, second zone 1106 may include a wider area that is single layered, and may therefore allow for better evaporation of sweat and other desirable effects. The zones may therefore by non-symmetric in orientation about axis 1114.

Furthermore, zone division line 1116 may be located within the sock in a specific location so as to place the double/single layers of materials in a particular fashion. Namely, zone division line 1116 may be located midway up heel portion 208, as shown in FIG. 11. In this way, double layers of material present in first zone 1104 may extend through an Achilles area of a wearer's foot (generally corresponding to the location of first ankle portion 210 and second ankle portion 214 in finished sock 1100), down to a top portion of a wearer's heel without extending below the wearer's heel. Therefore, the wearer may experience increased blister resistance on the wearer's Achilles heel, while also experiencing increased heel stability due to the single layer of material located underneath the wearer's heel. Furthermore, although this location of zone division line 1116 as being midway up heel portion is shown only in FIG. 11, a zone division line may be so located in any embodiment discussed herein.

Figure 12:
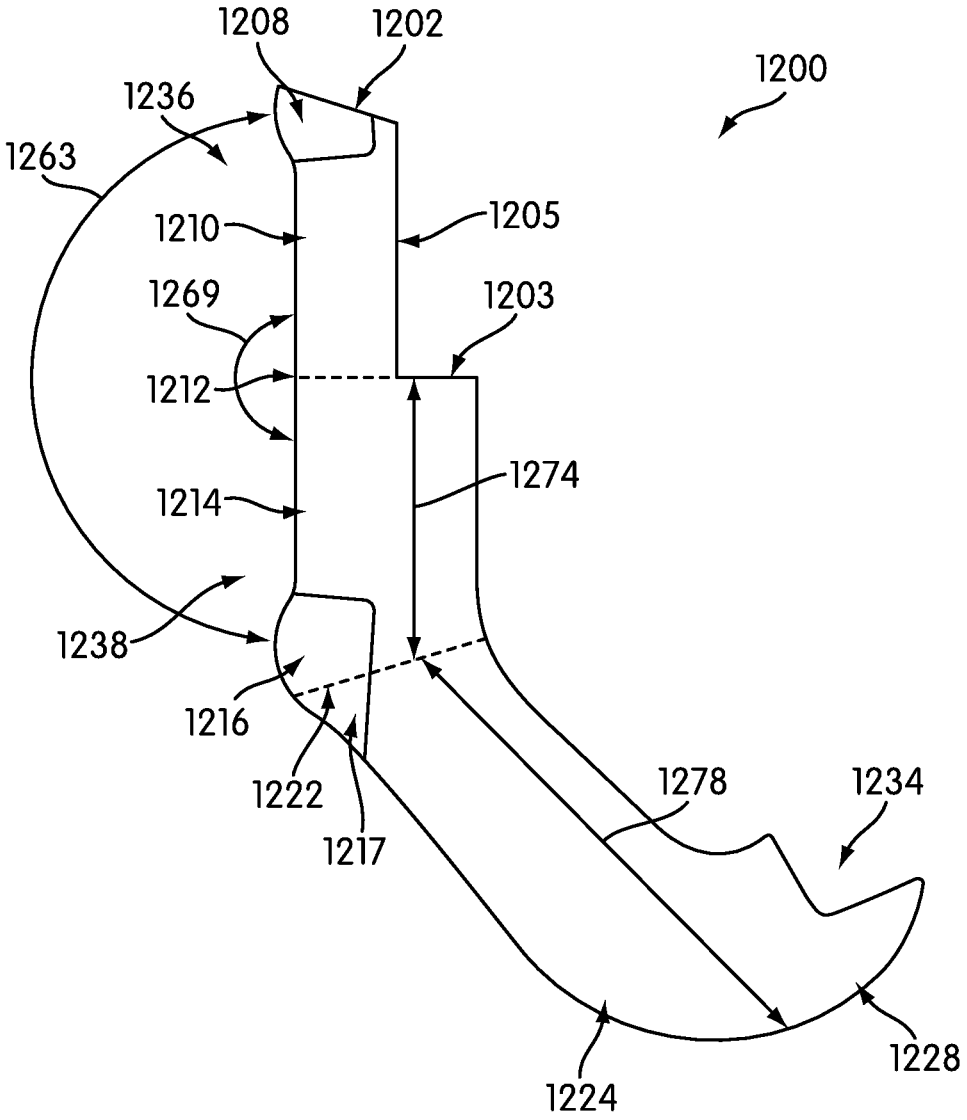
FIG. 12 is a fourth embodiment of a sock blank.

FIG. 12 shows a fourth embodiment of a sock blank 1200. Sock blank 1200 may be similar in some aspects to sock blank 500 as shown in FIG. 5. However, sock blank 1200 may include first portion 1236 that differs from first portion 536 of sock blank 500. In particular, first portion 1236 extends from first end 1202 of sock blank 1200 to fold line 1212. Instead of being tubular as in other embodiments discussed above, first portion 1236 in sock blank 1200 may be in the shape of a hollow semi-cylinder. Namely, first end 1202, side 1205 and fold line opening 1203 may all be open sides of sock blank 1200. Therefore, first portion 1236 may include first heel portion 1208 and first ankle portion 1210.

First portion 1236 may otherwise be symmetric with second portion 1238. Second portion 1238 may extend from fold line 1212 to zone division line 1222. Second portion 138 may include second ankle portion 1214. Second ankle portion may be partially symmetric about fold line 121 with first ankle portion 1210 as donated by arrows 1269. However, first ankle portion 1210 may only align with second ankle portion 1214 in a semi-cylinder, instead of throughout the entire circumference of a tube of the sock formed from sock blank 1200. Second portion 1238 may also include top heel portion 1216. Top heel portion 1216 may encompass the top and side of a wearer's heel, but not the bottom of a wearer's heel. Top heel portion 1216 may be symmetric about fold line 1212 with first heel portion 1208, as donated by arrow 1263. Each of first portion 1236 and second portion 1238 may have length 1274.

Sock blank 1200 may also include third portion 1224. Third portion 1224 may extend from zone division line 1222 to second end 1228 of sock blank 1200. Third portion 1224 may have length 1278, the value of which may depend on the location of zone division line 1222 within sock blank 1200.

Figure 13:
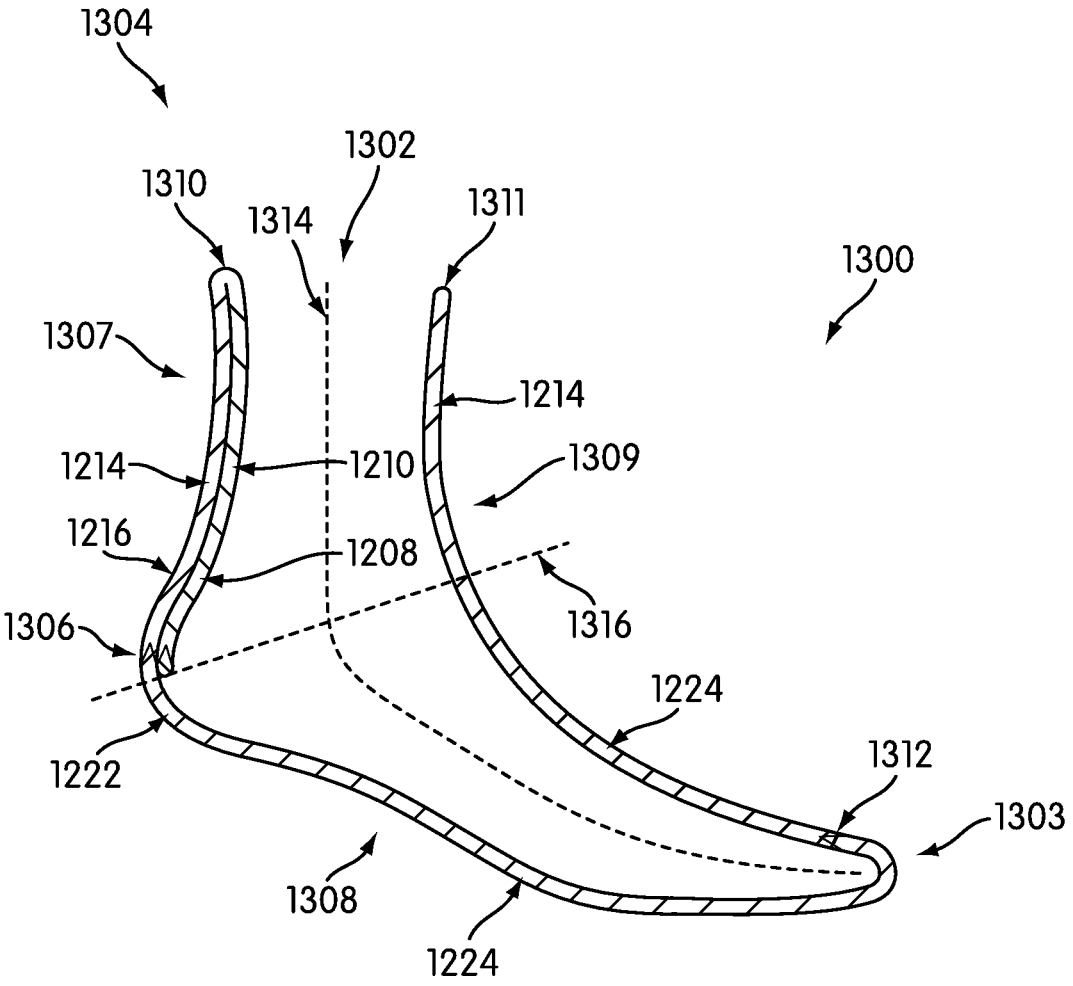
FIG. 13 is a seventh embodiment of a sock, manufactured from the sock blank of FIG. 12.

FIG. 13 shows a seventh embodiment of a sock 1300. Sock 1300 may be manufactured from sock blank 1200 as shown in FIG. 12. In particular, sock 1300 may be manufactured from sock blank 1200 by folding first portion 1236 into (or on top of, as discussed with respect to sock 900) second portion 1238 and adding attachment 1306. As a result, sock 1300 may include first zone 1304 that is partially double layered, and second zone 1308 that is singled layered. First zone 1304 and second zone 1308 may be denoted by zone division line 1316.

In the particular embodiment of sock 1300 as shown in FIG. 13, in contrast to other embodiments discussed herein, only part of first zone 1304 is double layered. Namely, the rear side 1307 is double layered. Rear side 1307 of sock 1300 may be associated with a wearer's Achilles tendon area and heel area. On the other hand, front side 1309 of sock 1300 in first zone 1304 may be single layered. Accordingly, on rear side 1307 sock 1300 may include a first layer of material made from portions 1208 and 1210 and a second layer of material made from portions 1214 and 1216. The two layers may be anchored at one end of first zone 1304 by fold 1310 and at the other end of first zone 1304 by attachment 1306.

As a result of this configuration, sock 1300 may include double layers in the specific location on a wearer's foot that may be most associated with blistering, while also having only a single layer throughout the remainder of sock 1300.

Generally, as a result of the above discussed configurations of various socks, the present disclosure provides articles and methods for manufacturing those articles that enable socks to localize zones of varying numbers of layers. Localization of the double layer, or single layer, to a particular area on a wearer's foot allows for advantages of double layers to be balanced against the advantages of single layers.

A sock in accordance with this disclosure may further be tailored to suit the needs of an activity. Generally, the entirety of the sock blank used to make a sock in accordance with this disclosure is continuously knit. However, one or more portions of the sock blank may differ with another portion of the sock blank with respect to at least one property. For example, a portion of a sock blank that will constitute a single layer zone may be knit differently than portions of the sock blank that will constitute the double layer zone(s).

Generally, these properties that may differ from one zone to another may include elasticity, strength, softness, friction, density, thickness, liquid absorption, shock absorption, appearance, color, knitting type, knitting pattern, yarn composition, yarn thickness, and yarn count. For example, in sock 400, portion 224 making up single layer second zone 406 may be loosely knit in order to further favor perspiration evaporation, while portions 210 and 214 may be tightly knit in order to provide additional strength. Accordingly, socks may be produced in accordance with this disclosure that are particularly suitable to one specific activity, such as running or soccer.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

The invention claimed is:

1. A sock with zones of varying numbers of layers of material, the sock comprising:

a first zone surrounding a circumference of the sock and extending axially along a length of the sock from an open end of the sock to a zone division line, wherein the zone division line is located adjacent to a midfoot region of the sock, the first zone having an inner layer of material and an outer layer of material, wherein the inner layer of material and the outer layer of material form a heel and ankle portion of the sock; and a second zone adjacent to the first zone, the second zone surrounding the circumference of the sock and extending axially along the length of the sock from the zone division line in a direction away from the first zone toward a toe end of the sock, the second zone having a single layer of material, wherein the inner layer of material includes a terminal end, and wherein the terminal end of the inner layer of material is attached to the zone division line by a first attachment mechanism that extends radially and entirely around the circumference of the sock.

2. The sock of claim 1, wherein the first zone and the second zone are continuously formed in the sock.

3. The sock of claim 1, wherein the inner layer of material of the first zone is coextensive with the outer layer of material of the first zone.

4. The sock of claim 1, wherein the first attachment mechanism includes stitching, knitting, or any combination thereof.

5. The sock of claim 1, wherein at least a portion of the second zone differs from at least a portion of the first zone with respect to at least one physical property selected from: elasticity, strength, softness, friction, density, thickness, liquid absorption, shock absorption, appearance, color, knitting type, knitting pattern, yarn composition, yarn thickness, and yarn count.

6. The sock of claim 1, wherein the inner layer of material is folded interior to the outer layer of material along an opening edge of the open end of the sock.

7. A sock having with one or more zones of varying numbers of layers of material, the sock comprising:

a tubular structure having an open end, a closed end located opposite to the open end, a first zone, and a second zone;

the first zone surrounding a circumference of the tubular structure and extending axially along a length of the tubular structure from the open end to a zone division line, wherein the first zone extends through a heel and a mid-foot region of the sock, and wherein the first zone includes an outer layer of material and an inner layer of material that are folded on top of one another forming a folded edge, the inner layer of material and the outer layer of material being coextensive with one another and extending from the folded edge to the zone division line, and the second zone being adjacent to the first zone, the second zone surrounding the circumference of the tubular structure and extending from the zone division line in a direction away from the first zone toward the closed end of the sock, wherein the second zone is comprised of a single layer of material, wherein the inner layer of material includes a terminal end, and wherein the terminal end of the inner layer of material is attached to the zone division line by an attachment mechanism that extends radially and entirely around the circumference of the tubular structure.

8. The sock of claim 7, wherein the attachment mechanism includes stitching, knitting, or any combination thereof.

9. The sock according to claim 7, wherein the folded edge is coextensive with an opening edge of the open end of the sock.

10. The sock according to claim 7, wherein the first zone and the second zone are continuously formed in the tubular structure.

11. The sock of claim 7, wherein the inner layer of material is folded interior to the outer layer of material.

12. The sock of claim 7, wherein the single layer of material of the second zone is an extension of the outer layer of material of the first zone.

13. The sock of claim 7, wherein the zone division line is located adjacent to a midfoot region of the sock.

14. A method for fabricating a sock with zones of varying numbers of layers of material, the method comprising:

knitting a first layer of material of a first zone of a tubular knit structure on a circular knitting machine, wherein the first layer of material of the first zone surrounds a circumference of the tubular knit structure and axially extends along a length of the tubular knit structure from a first terminal end to a fold line;

continuously knitting a second layer of material of the first zone of the tubular knit structure, wherein the second layer of material continuously extends from the fold line of the first layer of material to a zone division line of the tubular knit structure, and wherein the first zone extends through a heel and a mid-foot region of the sock;

continuously knitting a second zone of the tubular knit structure with the second layer of material of the first zone, wherein the second zone surrounds the circumference of the tubular knit structure and extends axially from the zone division line to a second terminal end of the tubular knit structure;

folding the first layer of material of the first zone of the tubular knit structure to form a folded edge coextensive with the fold line so that the first layer of material of the first zone is located interior to the second layer of material of the first zone, such that the first layer of material and the second layer of material of the first zone are coextensive and extend from the folded edge to the zone division line, and so that in the sock, the first zone is double layered and the second zone is single layered; and radially attaching the first terminal end of the first layer of material of the first zone around an entirety of the circumference of the tubular knit structure along the zone division line by applying an attachment mechanism, such that the first layer of material of the first zone and the second layer of material of the first zone entirely circumscribe and extend around the entirety of the circumference of the tubular knit structure.

15. The method of claim 14, wherein the attachment mechanism includes one or more of stitching, knitting, or any combination thereof.

16. The method of claim 14, wherein the folded edge is coextensive with an opening edge of the sock.

17. The method of claim 14, wherein at least a portion of the second zone differs from at least a portion of the first zone with respect to at least one physical property selected from: elasticity, strength, softness, friction, density, thickness, liquid absorption, shock absorption, appearance, color, knitting type, knitting pattern, yarn composition, yarn thickness, and yarn count.

* * * * *